US007018966B2

(12) United States Patent
Stoessel et al.

(10) Patent No.: US 7,018,966 B2
(45) Date of Patent: Mar. 28, 2006

(54) COMPOSITIONS AND METHODS FOR PREVENTING GEL FORMATION COMPRISING A SILOXANE AND AN ALKYLAMINE

(75) Inventors: Steven Stoessel, Niskayuna, NY (US); Renu Aggarwal, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 139 days.

(21) Appl. No.: 10/692,104

(22) Filed: Oct. 23, 2003

(65) Prior Publication Data

US 2004/0087464 A1 May 6, 2004

Related U.S. Application Data

(63) Continuation-in-part of application No. 10/171,312, filed on Jun. 13, 2002, now abandoned.

(51) Int. Cl.
*C11D 3/30* (2006.01)
*C11D 9/36* (2006.01)

(52) U.S. Cl. ..... 510/283; 510/276; 510/281; 510/282; 510/283; 510/285; 510/332; 510/466

(58) Field of Classification Search ..... 510/276, 510/281, 282, 283, 285, 332, 466
See application file for complete search history.

(56) References Cited

U.S. PATENT DOCUMENTS

| | | | | |
|---|---|---|---|---|
| 3,807,949 | A * | 4/1974 | D'Albignac et al. | 8/602 |
| 4,118,344 | A | 10/1978 | DeShon | |
| 4,119,779 | A * | 10/1978 | Grier et al. | 544/215 |
| 4,221,688 | A * | 9/1980 | Johnson et al. | 524/251 |
| 4,685,930 | A | 8/1987 | Kasprzak | |
| 4,936,917 | A * | 6/1990 | Harakal et al. | 106/38.22 |
| 5,066,520 | A * | 11/1991 | Freiberg et al. | 427/379 |
| 5,683,473 | A | 11/1997 | Jureller et al. | |
| 5,707,613 | A | 1/1998 | Hill | |
| 5,942,007 | A | 8/1999 | Berndt et al. | |
| 6,042,617 | A | 3/2000 | Berndt | |
| 6,042,618 | A | 3/2000 | Berndt et al. | |
| 6,045,588 | A | 4/2000 | Estes et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,086,635 | A | 7/2000 | Berndt et al. | |
| 6,159,917 | A | 12/2000 | Baran, Jr. et al. | |
| 6,190,420 | B1 | 2/2001 | Reynolds | |
| 6,271,295 | B1 | 8/2001 | Powell et al. | |
| 6,310,029 | B1 | 10/2001 | Kilgour et al. | |
| 6,372,830 | B1 | 4/2002 | Sato et al. | |

FOREIGN PATENT DOCUMENTS

| | | |
|---|---|---|
| EP | 1041189 A1 | 10/2000 |
| EP | 1043443 A1 | 10/2000 |
| JP | 2000313900 | 10/2000 |
| JP | 2000319694 | 10/2000 |

* cited by examiner

*Primary Examiner*—Charles Boyer
(74) *Attorney, Agent, or Firm*—Jason K. Klindtworth; Jean K. Testa

(57) ABSTRACT

The present invention relates to a cleaning composition comprising an emulsion comprising a polar co-solvent, a non-polar co-solvent, and an alkylamine dispersed throughout the emulsion. The alkylamine serves to prevent the emulsion from inverting and forming a thick, slippery gel, which is known to interfere with the cleaning process and washing machine components. Further, the present invention relates to a method for preventing gel formation by adding an alkylamine to an emulsified cleaning composition and washing stained articles therein.

In another aspect of the present invention a method for pre-treating a stained article is provided comprising applying a cleaning composition in the form of a gel comprising an emulsion of a polar co-solvent and a siloxane-based non-polar co-solvent, and a detergent to the article, allowing the cleaning composition to penetrate the stain; and laundering the article in a siloxane based cleaning composition comprising an alkylamine.

20 Claims, No Drawings

COMPOSITIONS AND METHODS FOR PREVENTING GEL FORMATION COMPRISING A SILOXANE AND AN ALKYLAMINE

CROSS REFERENCE TO RELATED APPLICATIONS

This application is a Continuation-In-Part of commonly owned U.S. patent application Ser. No. 10/171,312, filed Jun. 13, 2002, now abandoned of Stoessel et al., the disclosure of which is herein incorporated by reference.

FIELD OF THE INVENTION

This invention relates to the field of dry cleaning of clothing, textiles and the like. The invention is more particularly drawn toward additives for eliminating gel formation and pre-treating stains in siloxane-based dry cleaning.

BACKGROUND OF THE INVENTION

In the early days of dry-cleaning, kerosene was used to remove oil based stains from fabric. This proved dangerous as kerosene is highly flammable. Around the time of World War II, the dry cleaning industry used other volatile synthetic solvents such as, carbon tetrachloride and trichloroethylene. During the late 1940's and early 1950's these toxic compounds were replaced with perchloroethylene (PERC), which became the solvent choice for the industry. PERC was thought to be safer than its predecessors and produced a cleaner product, in less time, and with less equipment. This allowed for dry cleaning establishments to open in retail venues and offer quick turn around times.

PERC is an excellent dry-cleaning solvent. However, it has since been discovered that PERC is carcinogenic and an environmental hazard. There are some municipalities which have banned the use of PERC in the dry cleaning industry. Alternative dry-cleaning solvents include Stoddard (hydrocarbon) solvents and siloxanes.

Whichever solvent is employed, professional dry-cleaning processes often use distillation to clean the solvent between uses. This process has a large energy cost and produces dangerous solvent vapors which must be recaptured and condensed for further use.

A frustrating issue faced by the dry-cleaning industry is the non-uniformity of dirt and stains which occur on article, particularly clothing. Stains can be separated into two general categories: lipophilic or oil-based compounds such as those left by body oils, fats and greases, cosmetics, and other highly aliphatic materials; and hydrophilic or water-soluble compounds such as fruit juice, ink and wine. A hydrophilic solvent will not dissolve oil-based stains and, conversely, a lipophilic solvent will not dissolve water-based stains.

Common practice in the dry cleaning industry is to pre treat or "spot clean" the water-based stains, and then dry-clean the garment, followed by a post treatment of any remaining water-based stain to ensure removal. This is a laborious process involving a close visual inspection of each garment, followed by the marking and treatment of stains with an appropriate cleaning method. To conduct the process in an acceptable manner not only requires considerable time and extra cleaning equipment, but also extensive experience to recognize and employ the correct cleaning techniques. Thus, it would be beneficial to use a solvent solution which could treat both water and oil-based stains, thereby eliminating the need for extra workers to inspect and treat garments with mixed stains.

There is no acceptable solution to the problem of mixed stains available to the individual consumer. Many garments are "dry-clean" only, as certain articles, such as silk and wool, will shrink or deform if they are washed in water. Therefore, these materials must be sent to a professional dry cleaner, which is an expensive and time-consuming endeavor. Furthermore, as discussed above, dry-cleaning may not be effective on all types of stains and workers may fail to detect all remaining stains before the article is returned to the consumer.

It would, therefore, be desirable to have a dry-cleaning cleaning fluid which is effective on both oil-based stains and water-based stains, and would not damage water-sensitive articles. It would be more desirable to have such a cleaning fluid that were also safe enough to be used by consumers in their home as well as by professional dry cleaners.

A further problem associated with the dual phase cleaning emulsions of the present invention is their propensity to form inverted emulsions which appear as a gel in the wash solution or on the articles in the washing machine. The use of common laundry detergents, particularly those utilizing surfactants of an anionic nature such as sodium dodecylbenzene sulfonate and sodium lauryl sulfate, when emulsified in siloxane fluids with relatively small amounts of water or other immiscible polar solvents, provided effective cleaning while preserving the benefits of dry cleaning. However, a difficulty observed with this technique arises from the porous nature of the fabric and the phase behavior of the emulsions. For example, in cases where the polar phase has been used in excess, typically when the polar solvent's saturation limit in the clothing has been exceeded, a potential arises for the inversion of the emulsion.

For example, an initial water-in-oil emulsion can be partially inverted to a thick, slippery gel comprising an oil-in-water emulsion in which the water phase is now the continuous phase. This gel is insoluble in the primary water-in-oil emulsion. Further, in a washing machine, the gel cannot be easily rinsed away. It clings to the articles giving a greasy feeling and irritating detergent residue may be left on the clothing upon drying. If the gel is removed by mechanical action, the viscous nature of the gel allows it to clog filters and screens and interfere with the proper operation of the machine.

The use of inorganic salts such as sodium chloride will suppress the formation of an inverted emulsion. This suppression occurred at levels of about 0.2M $NaCl_{aq}$; however, the cleaning ability of the detergent also declines with increasing salt content. Lowering the salt content improves cleaning, but then the risk of gel formation rises. Therefore, it would be beneficial to have a method of suppressing gel formation independent of cleaning performance.

A critical parameter to any detergent is its ability to self-assemble and form micellar structures. Intermolecular attractions between the surfactant molecules cause them to group together and structurally align. This same factor is important in bubble, foam, and film formation. A good film is elastic enough to withstand deformations because of the good intermolecular attraction between surfactant molecules. However, the bonding must not be so tight as to prevent the ready diffusion of the surfactant molecules to weak spots in the film. These properties are strongly governed by the degree and type of self-assembly.

An old-fashioned notion of a good detergent required soaps to lather and foam, and although this is not a true statement, testing suggests that detergency and foaming are physically related. Not surprisingly, emulsions are another area in which dynamic and equilibrium film properties play a considerable role. The outside of an emulsion droplet has a film that acts much like the bubbles described above.

In situations where foaming and emulsions are not desirable, additives are employed. Some act by altering the packing ability of the surfactant. Previously flexible films can be made brittle with additional bonding (typically achieved with advantageous calcium ions in water washing) or weakened by the creation of flaws in the film. Addition of the bulky tributylphosphate bromide is one well-known reagent for the latter purpose.

The gel, an oil-in-water emulsion, occurring in the wash emulsion has been observed to be exceeding stable with lifetimes of over one year. Stable emulsions usually have surfactants capable of forming good films. From the above discussion, one way to prevent an emulsion's formation would be to change the film properties of the detergent's surfactant.

It would, therefore, be desirable to find an additive which would interact with the emulsified cleaning solution to effect the film properties of the detergent's surfactant to prevent gel formation, yet not interfere with the overall cleaning properties of the wash liquor.

Sometimes the cleaning ability of the wash emulsion is not enough to completely remove certain stains. The incorporation of a pre-spotter or pre-treatment step before the wash will often provide the additional cleaning power necessary to remove these stains. The infinite combinations of stains and soils, fabrics, dyes, weaves and yarns, and the physical condition and amount of each stain (such as degree of oxidation and set) make the task of developing a general detergent capable of removing every stain a very daunting chemical task. Realistically, most consumers accept that large stains, stains that have completely saturated the fabric, old stains, and unusual stains such as paint and tar, are unlikely to be removed by household detergents in water washing, and if these stains are to be removed, special treatments and detergents are required. Although the treatments may work by various actions, such as bleaching, enzymes, concentrated surfactants, pH gradients, emulsifiers and solvents, the pre-spotters share the characteristic of being applied directly to the stain, and only on the stain, and is applied by hand prior to the machine wash.

One problem associated with using household pre-spotters, particularly water based pre-spotters with siloxane-only water-free washing is the increased potential to make the stains worse, and possibly create new stains caused by residual detergents. It would, therefore, be desirable to employ a pre-spotter that is compatible with a siloxane based cleaning emulsion.

BRIEF DESCRIPTION OF THE INVENTION

The present invention provides a cleaning composition comprising an emulsion comprising a polar co-solvent, a non-polar co-solvent, and an alkylamine dispersed throughout the emulsion. The alkylamine serves to prevent the emulsion from inverting and forming a thick, slippery gel, which is known to interfere with the cleaning process and washing machine components.

The present invention also provides a method for preventing gel formation comprising adding an alkylamine to an emulsified cleaning composition comprising a polar co-solvent and a non-polar co-solvent, and washing articles in the emulsified cleaning composition with the alkylamine present therein.

In yet another aspect of the present invention a method for pre-treating a stained article is provided comprising applying a cleaning composition in the form of a gel comprising an emulsion of a polar co-solvent and a siloxane-based non-polar co-solvent, and a detergent to the article, allowing the cleaning composition to penetrate the stain; and laundering the article in a siloxane based cleaning composition comprising an alkylamine.

Features of a cleaning composition and a method for pre-treating and preventing gel formation of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

The compositions and methods for preventing inverted emulsions and pre-treating using inverted emulsions of the present invention provides numerous advantages over prior cleaning compositions and methods. For example, the present invention advantageously provides a composition and method for preventing inversion of the cleaning emulsion without reducing the cleaning effectiveness of the cleaning emulsion.

Another advantage is that the present invention provides a method for pre-treating stains, which is complementary with the wash solution so as to remove all types of stains. Embodiments of the present invention provide a method for pre-treating stains wherein the pre-treating composition is an inverted emulsion of the cleaning emulsion used in the wash cycle.

As will be realized by those of skill in the art, many different embodiments of a cleaning composition, method for preventing gel formation and method for pre-treating an article according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

In traditional water-based laundering, detergents are employed to remove insoluble stains and particulates. As used herein, the term "stain" as it related to cleaning solutions and methods refers to any undesirable foreign substance. It may be organic or inorganic, clear or colored, hydrophilic or lipophilic, liquid or solid, and is not meant to be limited to any particular class of compounds. The insoluble stains in water-based laundering are often lipophilic and as such, do not dissolve in water. The detergents used in laundering employ surfactants, which are molecules containing both hydrophilic and lipophilic groups. Their dual nature allows them to dissolve in water through the hydrophilic group while the lipophilic groups surround the oil-based stain and remove it from the article. The oil droplets are surrounded by the lipophilic groups, kept suspended in the water, and carried away from the article in the wastewater stream. While this is a highly effective method of removing stains from articles, which are amenable to water based washing, there are articles that are damaged by excess water, and this process cannot be used.

A related problem is that most surfactants, particularly charged (ionic) surfactants, are completely insoluble in non-polar cleaning solutions. Thus it is difficult to introduce them into the cleaning medium. Non-ionic surfactants are more soluble in non-polar cleaning solutions, however, they are less effective in cleaning hydrophilic stains.

Another problem occurs because many fabrics are slightly polar, such that if a polar stain is removed from the article, it is likely to redeposit back onto the article before the end of the wash cycle. This occurs because the polar stain is more attracted to a high-energy surface such as the article, than a low energy medium such as the non-polar cleaning solution. This problem is discussed in more detail in "Surfactants and Interfacial Phenomena" $2^{nd}$ Ed., John Wiley & Sons, New York: 1989.

The invention includes a composition and method for cleaning articles at home or in a professional laundry. As used herein, the term "articles" is defined, for illustrative purposes and without limitation, as fabrics, textiles, garments, linens and any combination thereof. The compositions of the invention generally comprise at least one non-polar solvent, at least one polar solvent, at least one ionic surfactant, and at least one emulsifier. Various additives may also be employed in the practice of this invention as will be outlined later in this specification.

As used herein, the terms "emulsion" and "cleaning solution" are used interchangeably. Both refer to a composition comprising at least one non-polar solvent, at least one polar solvent and an emulsifier. The polar solvent is dispersed throughout the non-polar solvent in to form a microscopically heterogeneous stable dispersion.

Non-Polar Solvent

In one embodiment of the invention, the non-polar solvent component makes up the bulk of the cleaning emulsion. It may be present in any amount less than 100 percent and is preferably present in an amount greater than 75 percent, and more preferably from 93 to about 99 weight percent based on the total weight of the cleaning solution. The non-polar solvent functions to break up lipophilic stains on articles and carry the stains away from the article in the wash solution. The non-polar solvent is also the carrying medium for the other constituents of the cleaning solution. Suitable non-polar solvents for use in the invention include those that, while effectively eliminate lipophilic stains from article, will not discolor or fade the articles by attacking the coloring agents used therein. In one embodiment of the invention the non-polar solvents comprise, siloxanes, such as cyclic siloxanes. In another embodiment of the invention the non-polar solvent comprises decamethylcyclopentasiloxane. Small percentages of higher cyclic homologues such as, dodecylmethylcyclohexasiloxane, tetradecylmethylcycloheptasiloxane, and hexadecylmethylcyclooctasiloxane, may exist in the decamethylcyclopentasiloxane. In further embodiments of the invention non-polar solvents include supercritical carbon dioxide or fluorinated refrigerants such as chlorinated fluorocarbons. In still further embodiments of the invention, other petroleum distillates such as Stoddard petroleum distillate or mineral spirits or synthetic hydrocarbons such as Exxon's DF-2000™ may be employed.

Polar Solvent

Non-polar fluids are effective at removing lipophilic stains from articles. However, they are not effective at removing hydrophilic stains. Therefore, a polar solvent may be added to the cleaning solution to aid in the removal of such hydrophilic stains. The polar solvent employed in the invention functions to dissolve the water-based stains from the article to be cleaned. Additionally, the polar solvent carries hydrophilic additives which may be desirable in the cleaning solution. Polar solvents suitable for use in the invention include those that will break up and dissolve hydrophilic stains and can be emulsified in the non-polar solvent of the invention. Therefore, the polar solvent must be immiscible in the non-polar solvent so that they may be emulsified. In one embodiment of the invention, the polar solvent comprises water. Water provides a good polar solvent and is also readily solubilizes the ionic surfactants and additives used in some embodiments of the invention. In still further embodiments of the invention glycols, phenols, nitrites, aprotic solvents, ketones, aldehydes, simple alkyl alcohols and glycerin are some examples of suitable polar solvents.

Polar solvents do present a problem with certain articles. Traditional dry-cleaning was invented as a method of removing lipophilic stains, but it also allows for certain articles to be cleaned which do not react well to polar liquids. A polar solvent, such as water, when applied to certain articles may permanently discolor, mar or deform the article.

In some embodiments of the invention the amount of polar solvent may vary but will generally comprise a sufficient amount to provide an acceptable level of cleaning. In one embodiment of the invention, the amount of polar solvent will be not greater than 30 weight percent based on the total weight of the solution. In another embodiment of the invention, the polar solvent is present in an amount up to 10 weight percent based on the total weight of the solution. In a further embodiment of the invention the polar solvent is preferably present in an amount from about 0.25 to 5 weight percent based on the total weight of the solution, and more preferably present in an amount from about 1.5 to about 3.5 weight percent based on the total weight of the solution.

Emulsifier

In one embodiment of the invention the polar solvent and non-polar solvent may not be miscible in one another. In order to achieve an emulsion, an emulsifying agent may be employed. Surfactants make good emulsifiers for the purposes of this invention. In another embodiment of the invention non-ionic surfactants mat be employed as emulsifiers for the cleaning solution. They are more soluble in the non-polar liquid which comprises the major portion of the cleaning solution. Suggested emulsifiers include, but are not limited to; poly(ethylene glycol)s, poly(propylene glycol)s, sorbitan sesquioleate, sorbitan oleate, sorbitan isostearate, sorbitan trioleate, sodium bis(2-ethylhexyl)sulfosuccinate, polyglyceryl-3 oleate, fatty acid esters, and alkylalkoxy alcohols. In another embodiment of the invention, emulsifiers comprise sodium dodecylbenzene sulfate or sodium lauryl sulfate.

In further embodiments of the invention emulsifiers include siloxane based emulsifiers. Examples of these include ethoxylated and propoxylated siloxanes such as a dimethylsiloxane (60% propylene oxide, 40% ethylene oxide) block copolymer or siloxanes and silicones, dimethyl, 3-hydroxypropyl methyl, ethers with polyethylene-polypropylene glycol mono-butyl ether. Examples of these are sold under the trade names General Electric SF1188A and Toshu TSF 4452, respectively.

Emulsifiers used in the practice of this invention generally comprise 0 to 1.5 weight percent based on the total weight of the emulsion. However, one skilled in the art will recognize that the amount of emulsifier needed will vary according to types and amounts of polar and non-polar solvents used.

Ionic Surfactant

In one embodiment of the invention, an additional surfactant is employed to assist in cleaning any hydrophilic stains. An ionic surfactant reduces surface tension and surrounds the particle or hydrophilic stain and solubilizes it in the emulsion. The ionic surfactant may also assist in emulsifying the mixture. Surfactants suitable for use in cleaning compositions are known to those of skill in the art. Generally the ionic surfactants suitable for use in the invention comprise molecules with a highly charged head group and a hydrophobic tail, wherein the molecule further comprises a hydrocarbon tail of 12 to 20 carbon atoms. Further suitable surfactants for use in an embodiment of the invention may comprise a hydrophilic-lipophilic-balance (HLB) value of between 2 and 10.

While cationic, anionic, zwitterionic and amphoteric surfactants may be employed in the practice of the invention, anionic surfactants are preferred. Examples of suitable surfactants include, alkali metal soaps such as the sodium, potassium, ammonium, and alkylammonium salts of higher fatty acids containing from about 8 to 24 carbon atoms and alkali metal and ammonium salts of organic sulfuric reaction products having in their molecular structure and alkyl group containing from about 10 to about 20 carbon atoms and a sulfonic acid or sulfuric acid ester group. More specific examples of suitable surfactants include, but are not limited to, sodium dodecylbenzene sulfate, fluorinated surfactants like the DuPont Zonyl™ surfactants (such as Zonyl™ FSP or Zonyl™ FSK), sodium lauryl sulfate, sodium lauryl sulfonate, sodium state, sodium lauryl sulfate, ammonium lauryl ether sulfonate, dialkyldiethyloxylateammonium salt, perfluoroalkylsulfobetaines, perfluoroalkylphosphate, siloxane benzyltrimethylammonium salts, quarternary alkyl ammonium siloxanes, carboxyalkyl siloxanes and polyether siloxane surfactants.

In one embodiment of the invention, the ionic surfactant is present in an amount up to 2 percent based on the total weight of the solution. In another embodiment the ionic surfactant is present in an amount up to 1 weight percent based on the total weight of the solution.

Concentrated Cleaning Solution

In another embodiment of the invention, the cleaning solution may comprise a concentrated emulsion. In this embodiment the polar solvent, emulsifier, surfactant and additives are added to an amount of non-polar solvent in high concentrations to form a concentrated cleaning solution. In one embodiment of the invention, this concentrated cleaning solution may be mixed with excess non-polar solvent to dilute it before it is used. The relative amounts of these compounds will be significantly higher than in the non-concentrated embodiments described above. For example the polar solvent may comprise up to 60 percent by weight of the solution, the non-polar solvent may comprise up to 60 percent by weight of the solution, the emulsifier may comprise up to 7 percent by weight of the solution and the surfactant may comprise up to 10 percent by weight of the solution. In other embodiments additives may be included in the concentrated solution as well. It should be noted that regardless of the concentrations of the components of the concentrated solution, after mixing with excess non-polar solvent the relative concentrations of the components will be within the ranges given elsewhere in this specification.

Cleaning Solution Additives

In one embodiment of the invention, the cleaning solution comprises a variety of additives which enhance the effectiveness of the solution. These include disinfectants, deodorizers and brighteners among other additives.

Odor is largely a matter of perception. Individual humans do not perceive odors in the same manner; thus, what can be objectable to one person is not so to another. Secondly, people become habituated to constant odors and do not detect them after extended periods of time. Odors can be removed, neutralized, or masked with another scent. The course of action is largely dependent on the odor to be removed. For the purposes of the invention odor can be thought of as an invisible stain which is perceived through its effect on olfactory sensors.

Odor molecules can be chemically reacted to become odorless. Bleach is capable of oxidizing many organic compounds. However, as most articles are organic compounds, bleach will harm the article in the process. Disinfectants remove odor-producing bacteria. Soaps with general anti-bacterial properties commonly contain quaternary ammonium salts as the disinfectants. The quaternary ammonium chlorides have been established as effective odor-control materials in and of themselves, particularly in combination with perfumes. They are readily found in household cleaners. Citrus oils and some synthetic aldehydes have excellent masking and odor-countering abilities.

In one embodiment of the invention, effective deodorizers include ammonium bromide salts and dihexyldecyldimethylammonium salts. It should also be noted that odor removal is increased in the presence of certain polar solvents such as water and alcohol. In one embodiment of the invention, deodorizers are present in an amount up to about 1 weight percent based on the weight of the solution.

In other embodiments of the invention, odors are the result of bacteria and other microbes within the article, it is also desirable to add a disinfectant to the cleaning solution. Acceptable disinfectants include chlorine bleach, dimethyldichlorohydrantoin, ethanol, heptanal, glutaric dialdehyde, and Phenonip™.

Fabric Softeners

In one embodiment of the invention, one of the benefits of using certain non-polar solvents such as cyclic siloxane is that the garments are left with nice "hand"—that is, it feels nice, drapes well, and is largely free of wrinkles. It is believed that this is a result of residual solvent trapped in the pores of the clothes. However, this benefit slowly goes away when the siloxane fluid evaporates. However, the addition of reactive siloxanes can impart a long-term benefit. The use of siloxane fluids improves the application (allowing easier application, through reaction, addition during the wash cycle, etc.) verses the use of aqueous article softeners where the softening material is added as an emulsion during the rinse. Acceptable fabric softeners include, for example, long chain reactive siloxanes, aldehydes and anhydrides.

Bleaches

In one embodiment of the invention it may be desirable to use bleach for enhanced stain removal and color brightening. Use of perborates, percarbonates, and sodium hypochlorite can be accomplished by dispersing the materials in the polar phase of the emulsified cleaning fluid. Bleaches such as isocyanric chloride or hydantoin chloride can also be used to improve solubility in the non-polar phase.

Optical Brighteners and Blueing Agents

In another embodiment of the invention optical brighteners and blueing agents may be added to correct for natural graying of articles with age and the redeposition of soils during the wash cycle. These materials can be either water-soluble or disperse in the non-polar medium.

Lint Scavengers and Depilatory Agents

In one embodiment of the invention, additives which have been developed to assist in the removal of hair fibers and extraneous fibers removed from the article during wash may be employed. Extraneous threads and hair are often electrostatically bound to article. In polar washing solvents, the charge can be dissipated by the conductive solvent or the polar solvent can support the charges on the fiber allowing the fiber to be carried out with the wash solution. In a non-polar fluid such as siloxanes, the hair and lint remains adhering to the more polar article. Reagents that can react with or coat the hair and lint fiber to make it more lipophilic can serve as additives in the siloxane wash to remove these undesired materials during cleaning. Aminosiloxanes are known to react with fiber surfaces to form non-durable siloxane coatings that could remove hair. Specially developed materials, such as 2-methylpyrimidinethinone siloxanes react rapidly and selectively with a proteinous surface to make the hair more appealing to the non-polar phase.

Inversion Inhibitors

In another aspect of the present invention, additives are employed in the wash solution to prevent the emulsion from inverting and forming a gel as discussed earlier. The most effective additives for the prevention of gel formation are alkylamines. The addition of alkylamines to the polar/non-polar cleaning emulsion prevents gel formation without diminishing the cleaning performance, as is the case with inorganic salts.

Long-chain amines, particularly those having six or more carbon atoms in one chain, are more effective at suppressing the emulsion than short-chain amines. For example, dodecylamine is capable of inhibiting gel formation at concentrations below 120 ppm relative to the non-polar phase, and only mild gel formation was observed at concentrations at or below 70 ppm. When the gel formed, it consisted of fine droplets and lacked the viscosity of gel produced in the absence of amines. This lack of viscosity was a consistent feature of dodecylamine addition.

Short-chain amines are also acceptable for use in the present invention; however, they generally require higher concentration to suppress gel formation than long-chain amines. Inadvertently produced gels rise in viscosity as the chain-length of the added amine decreases for a given concentration. For example, it has been found that the use of n-propylamine failed to prevent gel formation and the gel was very thick and viscous. The addition of n-hexylamine will delay gel formation; however, after time a slight amount of thin, relatively fluid gel will eventually form.

In other embodiments of the present invention, linear amines $C_6$–$C_{16}$ are employed in the cleaning emulsion to prevent gel formation. In another embodiment of the present invention, primary unsubstituted amines are added to the emulsion to effectively prevent gel formation.

In a further embodiment of the present invention, an aminosiloxane is employed to prevent gel formation. Wash emulsions of embodiments of the present invention comprise water and a siloxane-based non-polar fluid. Aminosiloxanes are completely miscible in the solixane-based non-polar fluid and are therefore well suited for use in the present invention. Further, aminosiloxanes are clear, light-colored liquids commercially available in various molecular weights. In a further embodiment of the present invention, the aminosiloxanes are di-endcapped with n-propylamine functionality.

In one embodiment of the present invention, dodecylamine is added to the cleaning emulsion in an amount greater than 90 ppm relative to the non-polar phase. In a further embodiment the dodecylamine is present in an amount of between 90 and 130 ppm. In a still further embodiment of the present invention, the dodecylamine is present in an amount of about 110 ppm. While dodecylamine is generally effective in an amount of about 110 ppm, significantly more can be added to the cleaning emulsion without deleterious effects on the cleaning ability of the emulsion.

In another embodiment of the present invention, the amount of alkylamine added to the cleaning solution is inversely proportional to the length of the amine chain. The appropriate amount of alkylamine necessary to effectively prevent gel formation will be apparent to one skilled in the art with a minimal amount of testing. Generally, an excess amount can be added without adverse affects on the cleaning ability or other characteristics of the cleaning emulsion.

Though this invention is not bound by any particular theory, it is believed that the amines interfere with the film elasticity of the central surfactant by lowering the packing ability and the surfactants ability to form a stable film. The only clear correlation between a reagent's solubility or partition coefficient between oil and water and its ability to prevent inversion is that materials excessively soluble (or insoluble) in one phase or the other failed to inhibit gel formation. However, the manifest structural dependence of the phenomena indicates that micelle or film modification has some role.

Method of Cleaning Using Emulsions

In one embodiment the invention also comprises a method for cleaning articles using an embodiment of the aforementioned cleaning solution. The article to be cleaned is immersed in the cleaning solution, agitated for a length of time sufficient to dissolve the stains, and then the article is removed from the emulsion. There are several embodiments of the method of the invention, a few of which are enumerated herein.

In one embodiment of the invention, the practice of the invention takes place in a commercial dry-cleaning establishment. Machines in these establishments generally have capacities of 20 to 100 pounds of clothes. In another embodiment of the invention, the practice of the invention takes place in a home setting or public laundromat. In this embodiment a smaller washing machine is employed, generally with a capacity of 5 to 10 pounds of clothes.

In these embodiments of the invention, the articles to be cleaned are placed in a washing machine. This can be either a vertically oriented machine or a horizontally oriented machine. The articles are placed in a basket with holes to allow for drainage of the wash solution. The solution is then pumped into the machine to saturate the articles in the basket. This may be accomplished through a feed tube or by a spraying means which sprays the solution onto the articles in the basket as they are being agitated. The articles may be allowed to soak in the solution for a period of time to allow the cleaning solution to penetrate the articles and loosen the stains. The articles and the solution are then agitated for up to 20 minutes. The agitation time should be sufficient for the removal of any stains on the articles. Agitation time will vary depending on the types of article and stain as well as the formulation of the solution used. One skilled in the art will recognize the optimal agitation time for a given set of conditions.

In one embodiment of the invention, once the articles have been thoroughly agitated in the solution, they are separated from the cleaning solution. This may be achieved through a number of means either employed sequentially or in unison. Generally the wash solution is allowed to drain from the articles in the basket. The damp articles are then rotated at a speed of at least 350 revolutions per minute (rpm). In another embodiment of the invention the articles are rotated at between about 450 to about 750 rpm. This rotation will remove excess cleaning solution through centrifugal force.

In another embodiment of the invention, hot air may be passed through the articles as they are being rotated. Air is heated to between 110° F. and 170° F. In another embodiment of the invention the air is heated to between 140° F. and 170° F. In a further embodiment of the invention the air is heated to between 160° F. and 170° F. After the air is heated to the appropriate temperature, the hot air pass through the items volatilizing the remaining cleaning solution and removing it from the items.

After a predetermined amount of the cleaning solution has been removed from the articles, they may be removed from the machine. The cleaning solution, after it is separated from the articles, may be cleaned and reused. The cleaning solution may be cleaned through a number of means, including but not limited to a mechanical filter, particulate filter, water absorption media, and cleaning fluid adsorption media. The cleaning fluid adsorption media may be a packed bed column, a flat plate bed, a tortuous path bed, a membrane separator, a column with packed trays, combinations thereof or other similar means. The result is a cleaned solution which may be used repeatedly in the practice of the invention. The filter cartridge will have to be cleaned or replaced periodically as buildups of deposits occur.

In one embodiment of the invention a method for spot cleaning using a cleaning solution is provided. The cleaning solution of the invention is applied directly to the stain on the article to be cleaned. The solution may be rubbed into the stain or allowed to soak in for a predetermined length of time until the stain is suspended in the solution. Then the cleaning solution containing the stain may then be removed from the article. In another embodiment of the invention, after the solution is allowed to detach the stain from the article, the article may be washed according to other methods of the invention.

In another aspect of the present invention, the spot cleaning solution comprises the above-described inverted emulsions as a pretreatment compound for pretreating stains prior to washing. The gels formed by the inversion of the water/siloxane emulsion used in the cleaning process comprises a concentrated form of water and detergent, diluted with the siloxane-based fluid. More exactly, the gel is O/W emulsion with very low water content, typically 3 to 7 percent. Though the gels can be diluted with additional water to about 25 percent water based on the total weight of the gel.

Detergent and water act to remove the stains, and the emulsified decylmethylcyclopentasiloxane acts to remove detergent from the article and avoid detergent and water stains. As such, in embodiments of the present invention, the gels are employed as a prespotter to treat stains in a manner compatible with the siloxane washing process. The viscous nature of the gel allows it to be easily applied and spread over stains. As can be seen in the Examples, the overall cleaning effectiveness is increased with the use of inverted emulsion gel prespotters.

EXAMPLES

Example 1

Five pounds of clothes per load were washed with siloxane fluid alone and with water to establish baselines of cleaning and to determine performance relative to a list of critical factors for clothes care as seen in Table I. The stain removal and wrinkling tests were visual inspection tests with scores (1–5, 5 highest) assigned by trained observers. There are an infinite number of stain and article combinations, and the chemical interaction between stain and fiber has a large bearing on the difficulty of cleaning. Seven articles were chosen as representative of typical household laundry: acetate (acetate-modified cellulose, a hydrophobic fabric), cotton, linen, polyester (with the stains applied to the fleece side), rayon, silk, and wool. The fabrics were obtained from Textile Innovators, Inc., and conform to the test standards as free of sizings, etc. Ballast clothes were usually a 50/50 polyester/cotton blend or as the method indicated. The stains initially examined were chocolate ice cream, grape juice, red wine (burgundy), axle grease, and bacon grease. Later, modeling clay (a particulate soil) and grass juice were substituted for the greases. Wear tests counted threads removed from die cut fabric, and work (wash index) was determined by the change in brightness of graphite-impregnated clothes using a colorimeter.

TABLE I

Cleaning Performance Specifications

| Specification | Method | Target | Water Baseline |
|---|---|---|---|
| Stain Removal | AATCC 130-2000 | >3 | 4.6 |
| Oil Stain Removal | AATCC 130-2000 | >3 | 3.8 |
| Wrinkling | AATCC 124-1996 | >2 | 2.3 |
| Wear | Danish TIC, Series VII | <50 | 80 |
| Work | INSI/AHAM HLW-1-1987-4 | >70 | 110 |
| Shrinkage | AATCC | <3% | 8% |

The cleaning ability was assessed by standardized methods published by independent trade groups such as International Fabric Institute (IFI), Association of American Textile and Color Chemists (AATCC), American Home Appliance Manufacturers (AHAM), International Electro-Technical Commission (IEC), and the American Society for Testing and Materials (ASTM).

It was found that siloxane fluid was excellent for removing grease stains from clothing, even those that had been "set" by previous washing. However, siloxane fluid was poor at removing water-based stains, and the stain removal score did not meet the target, even when commercial siloxane dry-cleaning detergents were added. The wrinkling and wear values were 2 and 15, respectively, easily meeting the target.

Example 2

Once the emulsion with surfactants and additives was found to be effective in the invention, the following tests were run to determine if commercial laundry detergents could be used as an all in one additive to the emulsions. In order to assess this, the top end detergents from three major manufacturers (Proctor and Gamble, Colgate-Palmolive and Lever Brothers) were tested under the same conditions with a 2 percent water solution and a 3 pound clothing load. Furthermore, the stain set was expanded to include additional consumer relevant stains beyond the original stain set (chocolate, wine, grape juice, grass and clay). $\Delta E$ is the distance in color space that cleaning has changed the stain from its original color and wash index is a measure of the effectiveness of the work. There was not any significant change across the standard stain set (Table II), but the detergents had varying efficacy against individual stains (Table III). This indicates that it is acceptable to use off-the-shelf products in a home system which incorporates a water emulsion.

TABLE II

| Manufacturer | Brand | AATCC | ΔE | Wash Index |
|---|---|---|---|---|
| Procter & Gamble | Tide | 4.40 | 9.00 | 62.30 |
| Lever Bros. | Wisk | 4.30 | 12.58 | 65.84 |
| Colgate-Palmolive | Fab | 4.40 | 12.82 | 83.06 |

TABLE III

| Wider Stain Set | Spaghetti sauce | Maple syrup | Milk | Yellow mustard | Brown Mustard | Coffee |
|---|---|---|---|---|---|---|
| FAB/2% $H_2O$ | 4.43 | 5.00 | 5.00 | 2.02 | 3.31 | 4.76 |
| TIDE/2% $H_2O$ | 3.57 | 5.00 | 5.00 | 2.29 | 3.86 | 4.68 |
| Siloxane fluid (neat) | 2.48 | 1.26 | 2.67 | 1.05 | 1.38 | 2.69 |
| Water | 4.57 | 5.00 | 5.00 | 2.71 | 4.86 | 4.86 |

| | Ketchup | Cray-on | Lip-stick | Dri-write marker | Mayo | AVER-AGE |
|---|---|---|---|---|---|---|
| FAB/2% $H_2O$ | 4.02 | 4.95 | 1.36 | 2.71 | 4.75 | 3.85 |
| TIDE/2% $H_2O$ | 3.39 | 4.91 | 2.64 | 1.36 | 4.96 | 3.79 |
| Siloxane fluid (neat) | 1.17 | 4.71 | 2.14 | 1.21 | 4.10 | 2.26 |
| Water | 4.86 | 5.00 | 2.93 | 1.64 | 4.86 | 4.21 |

Example 3

A series of n-alkylamines were investigated for their ability to prevent gel formation with water/siloxane emulsions including a commercial detergent containing sodium dodecylbenzenesulfonate as the central surfactant, such as Tide®. A standard cleaning situation was set up wherein a cotton swatch measuring 1¾ in.×1¾ in. was stirred for 15 minutes in an emulsion of ¼% Tide (liq.), 1% water, and 250 mL of decamethylcyclopentasiloxane. When stirred at about 500 rpm, this emulsion was observed to invert and gel within 4 minutes. The gel was usually white in appearance, and deposited on the sides of the flask and on the swatch, as well as creating elongated strings in the solution.

Table 4 shows the results of adding varying concentrations of dodecylamine to these solutions. The amines were added to the siloxane solvent before addition of the water. After the amine was filly dispersed, the water-detergent mixture was added together with the fabric swatch, and stirred for 15 min at the previous rate.

TABLE 4

Results of Gel Reduction with Dodecylamine*

| g, amine | mol | ppm | observations |
|---|---|---|---|
| 0.0620 | 3.34E−04 | 248 | No gel |
| 0.0580 | 3.13E−04 | 232 | No gel |
| 0.0294 | 1.59E−04 | 118 | No gel |
| 0.0162 | 8.74E−05 | 65 | Very slight amount of thin fine gel |
| 0.0074 | 3.99E−05 | 30 | Gel at 4:00 min |

*15 min at about 500 rpm, 2.5 g of water, 0.62 g of liq. Tide, 250 mL of SB 32, 3.0 $in^2$ cotton swatch (~0.7 g), 600 mL beaker To improve solubility and ease of addition, an aminosiloxane was also tested. Aminosiloxanes are clear, light-colored liquids commercially available in various molecular weights, but are typically di-endcapped with n-propylamine functionality. Addition of 0.21 g ($1.6\times10^{-4}$ mol, 840 ppm) of $H_2NCH_2CH_2CH_2(Si(CH_3)_2O)_{15}CH_2CH_2CH_2NH_2$ under the test conditions inhibited gel formation completely. The siloxane was completely miscible in the dodecamethylcyclopentasiloxane and blended immediately.

Another important benefit of the amines is that the cleaning efficiency of the solution is not reduced by their presence. Thus, IEC swatches stained with blood, cocoa, and wine were still effectively cleaned in the emulsion at an amine concentration of 232 ppm of n-dodecylamine.

An extended series of amines, alcohols, thiols, and ammonium salts were examined to determine relevant structural factors in both the mechanisms and efficacy of these inhibitors. Table 5 shows the results. It was found that linear amines $C_6$–$C_{16}$ were most effective. Hexylamine and hexyldecylamine were less effective, i.e. required more amine to inhibit gel formation, than materials in the middle range. t-Octylamine was found to work, but substituted linear anilines were not as effective. All the other materials in the table failed to prevent slime although they were structurally similar.

TABLE 5

Structure effects of amines.*

| 1° amines | | 2° and 3° amines | | Quat. salts | | Alcohols | |
|---|---|---|---|---|---|---|---|
| hexylamine | +/− | dihexylamine | − | $Bu_4PCl$ | − | n-octane | − |
| octylamine | ++ | dioctylamine | − | $Bu_4NBr$ | − | 2-ethyl-1-hexanol | − |
| decylamine | ++ | tributylamine | − | | | n-dodecanol | − |
| dodecylamine | ++ | triethylamine | − | | | n-dodecyl sulfide | − |
| hexyldecylamine | + | ammonia | − | | | | |
| $(CH_3)_3CCH_2C(CH_3)_2NH_2$ | + | | | | | | |
| p-dodecylaniline | − | | | | | | |
| hexyldecylaniline | − | | | | | | |
| aniline | ? | | | | | | |

*+: effective at gel prevention −: ineffective at gel prevention

Referring to Table 6, dodecylamine was also tested for its ability to retard gel in a washing machine. Three pounds of clothes were washed under conditions known to cause gel formation in the presence of 110 ppm of dodecylamine. The gel formation was prevented, effective cleaning was maintained, and, in fact, slightly improved to 4.11 (out of 5 with 5 being perfectly clean) from 3.99 observed under identical wash conditions without the amine.

TABLE 6

| | Results of Cleaning conducted in Washing Machine with and without amine. | | | | | | |
|---|---|---|---|---|---|---|---|
| | Chocolate ice cream | Grape juice | Wine | Grass | Clay | Average | |
| | ¼% Tide and 110 ppm dodecylamine (2.5 g) | | | | | | |
| acetate | 4.30 | 4.83 | 5.00 | 5.00 | 5.00 | 4.83 | |
| cotton | 2.17 | 4.67 | 4.00 | 3.83 | 3.00 | 3.53 | |
| linen | 3.97 | 4.50 | 4.67 | 4.57 | 5.00 | 4.54 | |
| polyester | 2.67 | 4.67 | 5.00 | 5.00 | 4.67 | 4.40 | |
| rayon | 1.83 | 3.33 | 1.50 | 1.67 | 3.17 | 2.30 | |
| silk | 3.33 | 5.00 | 4.67 | 4.83 | 5.00 | 4.57 | |
| wool | 3.17 | 5.00 | 5.00 | 5.00 | 5.00 | 4.63 | |
| AVERAGE | 3.06 | 4.57 | 4.26 | 4.27 | 4.40 | 4.11 | σ = 0.33 |
| | ¼% Tide | | | | | | |
| acetate | 4.67 | 5.00 | 5.00 | 5.00 | 4.67 | 4.87 | |
| cotton | 2.00 | 4.00 | 2.83 | 4.13 | 3.33 | 3.26 | |
| linen | 3.97 | 4.00 | 3.67 | 4.50 | 4.50 | 4.13 | |
| polyester | 2.67 | 5.00 | 5.00 | 4.33 | 3.50 | 4.10 | |
| rayon | 1.83 | 3.00 | 2.33 | 3.83 | 2.33 | 2.67 | |
| silk | 4.50 | 4.83 | 5.00 | 4.67 | 4.83 | 4.77 | |
| wool | 3.67 | 5.00 | 4.83 | 4.00 | 3.17 | 4.13 | |
| AVERAGE | 3.33 | 4.40 | 4.10 | 4.35 | 3.76 | 3.99 | σ = 0.55 |

*visual cleaning scores using AATCC 130–2000 grayscale.

Example 4

Use of the inverted emulsions as a pre-spotter or pretreater for stains prior to washing was tested using two mixtures:

Mixture 1: A mixture of 188 mL of decamethylcyclopentasiloxane, 12 mL of water, 0.12 g of Tide™ liquid detergent (Deep Clean Formula, dye free), and 0.012 g of GE silicon fluid TSF 4452 was prepared in a beaker, and a 3 sq. in. clean cotton swatch was added. The mixture was then stirred at 500 rpm for 5 minutes resulting in a thick, white, viscous gel. (100% conversion)

Mixture 2: A mixture of 188 mL of decamethylcyclopentasiloxane, 12 mL of concentrated aqueous ammonium hydroxide, and 0.12 g of Tide™ liquid detergent (Deep Clean Formula, dye free), was prepared in a beaker, and a 3 sq. in. clean cotton swatch was added. The mixture was then stirred at 500 rpm for 5 minutes resulting in a thick, white, viscous gel. (100% conversion)

The gels were then applied on the stained clothes. The layer of gel was placed on the stain while the cloth was held over a layer of absorbent padding. After 3–5 minutes, the stain was rubbed gently with the applicator nozzle, and additional gel was applied as needed. After no further change was observed, the stained swatches were washed, and the effectiveness of cleaning was evaluated. Table 7 presents the results. Compared to the control (no pretreatment) the pre-spotters showed improvement. In addition, no detergent stains were observed on the clothes in either case.

TABLE 7

| Gel Prespotters | | |
|---|---|---|
| Condition | Score* | σ (± unit) |
| 1% water wash | | |
| No pretreatment | 2.47 | 0.05 |
| Solution from Mixture 1 | 2.69 | 0.06 |
| Solution from Mixture 2 ($NH_3$) | 2.48 | 0.06 |

TABLE 7-continued

| Gel Prespotters | | |
|---|---|---|
| Condition | Score* | σ (± unit) |
| Neat siloxane wash | | |
| No pretreatment | 1.97 | 0.20 |
| Solution from Mixutre 1 | 2.01 | 0.22 |
| Solution from Mixture 2 ($NH_3$) | 2.15 | 0.27 |

*AATCC130-2000 visual scoring, average of three graders, across 7 fabric, 5 stain set The foregoing description of several embodiments of the cleaning fluids and methods of cleaning of the invention have been presented for the purposes of illustration. Although the invention has been described in detail, it is to be clearly understood that the same is intended by way of illustration and example only and is not to be taken by way of limitations. Obviously many modifications and variations of the invention are possible in light of the above teaching. Accordingly, the spirit and scope of the invention are to be limited only by the terms of the appended claims.

What is claimed is:

1. A cleaning composition comprising:

an emulsion comprising a polar co-solvent and a selected from the group consisting of decamethylcyclopentasiloxane, an aminosiloxane, and mixtures thereof; and at least one alkylamine dispersed throughout the emulsion in an amount effective to prevent inversion of the emulsion, the at least one alkylamine selected from the group consisting of hexylamine, octylamine, decylamine, dodecylamine, hexyldecylamine, and $(CH_3)_3CCH_2C(CH_3)_2NH_2$.

2. The cleaning composition of claim 1 wherein the alkylamine comprises n-hexylamine.

3. The cleaning composition of claim 1 wherein the alkylamine comprises dodecylamine present in an amount greater than about 90 ppm relative to the non-polar co-solvent.

4. The cleaning composition of claim 1 wherein the alkylamine comprises dodecylamine present in an amount of about 110 ppm relative to the non-polar co-solvent.

5. The cleaning composition of claim 1 wherein the polar co-solvent comprises water.

6. The cleaning composition of claim 1 wherein the non-polar co-solvent comprises a siloxane based co-solvent.

7. The cleaning composition of claim 1 wherein the non-polar co-solvent is decamethylcyclopentasiloxane.

8. The cleaning composition of claim 7 wherein the aminosiloxane is diendcapped with n-propylamine functionality.

9. A cleaning composition comprising:

an emulsion comprising water and decamethylcyclopentasiloxane; wherein a linear amine $C_6$ to $C_{16}$ in length is present in an amount effective to prevent inversion of the emulsion.

10. A method for preventing gel formation comprising:

providing an emulsified cleaning composition comprising a siloxane based non-polar co-solvent and water;

adding an alkylamine to the emulsified cleaning composition in an amount effective to prevent inversion of the emulsion;

washing articles in the emulsified cleaning composition with the alkylamine.

11. The method for preventing gel formation of claim 10 wherein the alkylamine comprises a linear amine $C_6$ to $C_{16}$ in length.

12. The method for preventing gel formation of claim 10 wherein the alkylamine comprises dodecylamine.

13. The method for preventing gel formation of claim 12 wherein the dodecylamine is present in an amount greater than about 90 ppm relative to the non-polar co-solvent.

14. A method for pre-treating a stained article and subsequently laundering the article comprising:

applying a cleaning composition in the form of a gel comprising an emulsion of a polar co-solvent and a siloxane-based non-polar co-solvent, and a detergent to the article;

allowing the cleaning composition to penetrate the stain; and laundering the article in a siloxane based cleaning composition comprising an alkylamine.

15. The method of claim 14 wherein the alkylaime is present in an amount greater than 90 ppm based on the amount of siloxane.

16. The method of claim 14 wherein the polar co-solvent is ammonium hydroxide.

17. The method of claim 14 wherein the polar co-solvent is water.

18. The method of claim 17 wherein the siloxane based cleaning composition further comprises an emulsion comprising a siloxane-based fluid and water.

19. The method of claim 18 wherein the siloxane-based fluid comprises decamethylcyclopentasiloxane.

20. The cleaning composition of claim 1 wherein the non-polar co-solvent is an aminosiloxane.

* * * * *